US011152178B2

(12) United States Patent
Chen et al.

(10) Patent No.: US 11,152,178 B2
(45) Date of Patent: Oct. 19, 2021

(54) DISCONNECT SWITCHES WITH COMBINED ACTUATORS AND RELATED CIRCUIT BREAKERS AND METHODS

(71) Applicant: Eaton Intelligent Power Limited, Dublin (IE)

(72) Inventors: Steven Zhenghong Chen, Moon Township, PA (US); Mark A. Juds, New Berlin, WI (US); Paul R. Rakus, Coraopolis, PA (US); Michael Slepian, Murrysville, PA (US)

(73) Assignee: Eaton Intelligent Power Limited, Dublin (IE)

( * ) Notice: Subject to any disclaimer, the term of this patent is extended or adjusted under 35 U.S.C. 154(b) by 388 days.

(21) Appl. No.: 16/289,744

(22) Filed: Mar. 1, 2019

(65) Prior Publication Data

US 2020/0279709 A1 Sep. 3, 2020

(51) Int. Cl.

| | |
|---|---|
| ***H01H 33/66*** | (2006.01) |
| ***H01H 33/666*** | (2006.01) |
| ***H01H 71/24*** | (2006.01) |

(52) U.S. Cl.

CPC ..... *H01H 71/2454* (2013.01); *H01H 33/66* (2013.01); *H01H 33/666* (2013.01); *H01H 2205/002* (2013.01)

(58) Field of Classification Search

CPC .. H01H 33/66; H01H 33/666; H01H 33/6662; H01H 33/285; H01H 33/38; H01H 71/2454; H01H 2205/002; H01H 33/42; H01H 33/66207

USPC ..... 218/154, 120, 123, 134, 139, 140, 138, 218/155, 3, 4

See application file for complete search history.

(56) References Cited

U.S. PATENT DOCUMENTS

| | | | | |
|---|---|---|---|---|
| 3,250,880 | A * | 5/1966 | Jennings | H01H 33/66 218/118 |
| 3,597,556 | A | 8/1971 | Sharp et al. | |
| 3,914,568 | A * | 10/1975 | Crouch | H01H 33/666 218/123 |
| 4,087,664 | A | 5/1978 | Weston | |
| 4,204,101 | A | 5/1980 | Dethlefsen | |
| 4,250,363 | A * | 2/1981 | Heberlein | H01H 33/664 218/123 |
| 4,281,231 | A | 7/1981 | Griesen et al. | |
| 4,434,332 | A | 2/1984 | Yanabu et al. | |
| 5,905,242 | A | 5/1999 | Bernard et al. | |
| 8,952,826 | B2 | 2/2015 | Leccia et al. | |
| 9,208,966 | B2 * | 12/2015 | Sugiyama | H01H 3/32 |

(Continued)

OTHER PUBLICATIONS

Bosworth et al. "High Speed Disconnect Switch with Piezoelectric Actuator for Medium Voltage Direct Current Grids" IEEE Electric Ship Technologies Symposium, pp. 419-423 (2015).

(Continued)

*Primary Examiner* — William A Bolton

(74) *Attorney, Agent, or Firm* — Myers Bigel, P.A.

(57) ABSTRACT

Disconnect switches include a housing, a fixed main contact in the housing, a movable main contact in the housing in cooperating alignment with the fixed main contact, a first actuator coupled to the movable main contact, and a second actuator coupled to the housing. The second actuator is configured to apply a motive force to the housing that is in a direction opposing a motive force applied by the first actuator to the movable main contact.

20 Claims, 8 Drawing Sheets

(56) References Cited

U.S. PATENT DOCUMENTS

| | | | | |
|---|---|---|---|---|
| 9,299,519 | B2 * | 3/2016 | Matsui | H01H 33/143 |
| 2016/0225557 | A1 * | 8/2016 | Kanaya | H01H 33/6661 |
| 2017/0352507 | A1 | 12/2017 | Kim et al. | |
| 2018/0005784 | A1 | 1/2018 | Nagatake et al. | |
| 2018/0294115 | A1 | 10/2018 | Hwang et al. | |

OTHER PUBLICATIONS

Peng et al. "A Fast Mechanical Switch for Medium Voltage Hybrid DC and AC Circuit Breakers" IEEE Transactions on Industry Applications 52(4):2911-2918 (2015).

Peng et al. "Evaluation of Design Variables in Thompson Coil based Operating Mechanisms for Ultra-Fast Opening in Hybrid AC and DC Circuit Breakers" IEEE Applied Power Electronics Conference and Exposition, pp. 2325-2332 (2015).

Wu et al. "A New Thomson Coil Actuator: Principle and Analysis" IEEE Transactions on Components, Packaging and Manufacturing Technology 5(11): 1644-1654 (2015).

* cited by examiner

FULLY CLOSED STATUS

INITIAL OPEN STATUS

FULLY OPEN STATUS

DISCONNECT SWITCHES WITH COMBINED ACTUATORS AND RELATED CIRCUIT BREAKERS AND METHODS

FIELD OF THE INVENTION

The present invention relates to circuit interrupters.

BACKGROUND OF THE INVENTION

Circuit interrupters provide protection for electrical systems from electrical fault conditions such as, for example, current overloads, short circuits and abnormal level voltage conditions. Typically, circuit interrupters include a stored energy type operating mechanism which opens electrical contacts to interrupt the current through the conductors of an electrical system in response to abnormal conditions, although a wide range of driving mechanisms may be employed.

Circuit interrupters can be high voltage or low voltage. Referring to FIG. 1, circuit interrupters, such as, for example, power circuit breakers for systems operating above about 1,000 volts, typically utilize a vacuum interrupter (VI) 15 as the switching devices but lower rated devices may also use VIs. The circuit interrupters include separable main contacts 16, 17 disposed within an insulating housing 15*h*. Generally, one of the contacts 16 is fixed relative to both the housing 15*h* and to an external electrical conductor which is interconnected with the power circuit associated with the circuit interrupter. The other contact 17 is moveable. In the case of a VI, the moveable contact assembly usually comprises a stem 15*s* of circular cross-section having the contact 17 at one end enclosed within a vacuum chamber 15*c* and an actuator driving mechanism coupled at the other end which is external to the vacuum chamber 15*c*. The actuator driving mechanism provides the motive force to move the moveable contact 17 into or out of engagement with the fixed contact 16. See, e.g., U.S. Pat. No. 8,952,826 to Leccia et al., the contents of which are hereby incorporated by reference as if recited in full herein.

VIs are typically used, for instance, to reliably interrupt medium voltage alternating current (AC) currents and, also, high voltage AC currents of several thousands of amperes or more. Conventionally, one VI is provided for each phase of a multi-phase circuit and the VIs for the several phases are actuated simultaneously by a common operating mechanism, or separately by separate operating mechanisms (and separate auxiliary switches).

Conventional interruption times are on the order of about 30 ms to about 85 ms. There remains a need for disconnect switches that can provide a faster opening gap for use with power distribution systems.

SUMMARY OF EMBODIMENTS OF THE INVENTION

Embodiments of the present invention provide circuit interrupters that have ultrafast movement to provide a small (interruption) opening gap between the fixed and movable contact.

Embodiments of the invention are directed to disconnect switches that include: a housing; a fixed main contact in the housing; a movable main contact in the housing in cooperating alignment with the fixed main contact; a first actuator coupled to the movable main contact; and a second actuator coupled to the housing. The second actuator is configured to apply a motive force to the housing that is in a direction opposing a motive force applied by the first actuator to the movable main contact.

The disconnect switch can further include: a vacuum interrupter body enclosing the housing; a vacuum chamber provided by the housing, wherein the fixed and moveable main contacts reside in the vacuum chamber; a first drive rod in the vacuum interrupter body coupled to and extending between the movable contact and the first actuator; and a second drive rod in the vacuum interrupter body coupled to and extending between the housing and the second actuator.

The disconnect switch can further include a contact spring coupled to the housing and residing between the housing and the second actuator. In operation, during a closed state of the disconnect switch, the contact spring applies a closing force toward the movable main contact.

The disconnect switch has an open position associated with fully open state and a closed position associated with a fully closed state allowing electrical conduction. In the open position, the fixed and movable main contacts are spaced apart. In the closed position, the fixed and movable main contacts abut, and wherein the second actuator is configured to apply a latching force to latch the movable and fixed main contacts together in the closed position and apart in the open position.

The disconnect switch can further include a controller in communication with the first actuator and the second actuator, and wherein the controller directs the first and second actuators to actuate to move in opposing directions during an opening operation.

The disconnect switch can include a coupler assembly that directly or indirectly attaches the second actuator to the housing. The coupler assembly can include a contact spring chamber that holds a contact spring. The second actuator can include a coupler attachment member that is configured to compress the contact spring to apply a closing and/or latching force against the housing in a direction toward the movable main contact.

In some embodiments, only the first actuator provides a motive force to move the movable main contact to an initial interruption gap position in a first direction and only the second actuator provides a motive force to move the housing in a second direction opposing the first direction to move the fixed main contact away from the movable contact whereby the fixed and movable main contacts are spaced apart in an insulation gap position. There is a greater spacing between the fixed and movable main contacts in the insulation gap position.

During an opening operation, the second actuator can move the vacuum interrupter body away from the first actuator and the disconnect switch can have a gap space between an end of the vacuum interrupter body facing the second actuator and an adjacent support member. When the disconnect switch is in a fully closed state and an initial open state, the gap space can be greater than when in a fully open state.

The disconnect switch can further include a support member residing between an end of the vacuum interrupter body and the first actuator. When the disconnect switch is in a fully closed state and an initial open state, the gap space can be less than when in a fully open state.

When in the fully closed state, the gap space can be in a range of 5-20 mm.

The first actuator can move the movable main contact at a first velocity to an initial interruption gap position away from the fixed main contact that is in a range of about 1-3 mm. The second actuator can move the housing at a second velocity that is less than the first velocity and at a distance that is in a range of about 3 mm-15 mm whereby the disconnect switch has an isolation gap between the fixed and movable main contacts that is in a range of about 5 mm-15 mm.

The first actuator can be configured to apply a motive force to move the movable main contact away from the fixed main contact to provide the initial interruption gap in less than 3 ms, optionally in 1 ms or less, then stops applying the motive force. The second actuator can be configured to apply a motive force to move the housing to a full opening travel distance in 20-50 ms whereby the fixed and movable main contacts are separated by the isolation gap.

The first and second actuators can be axially aligned and spaced apart with the housing therebetween. The first and second actuators can each comprise a coupling drive member that are axially aligned with each other and extend external to a vacuum interrupter body enclosing the housing therein.

The first actuator can be a Thompson coil actuator.

The disconnect switch can be provided in a cabinet housing of a circuit interrupter comprising a plurality of poles.

Embodiments of the invention are directed to methods of moving primary contacts of a disconnect switch. The methods include: providing a vacuum interrupter disconnect switch with a vacuum chamber enclosing a fixed contact and a movable contact, the disconnect switch includes first and second drive actuators; actuating the first drive actuator to apply a motive force to the movable contact in a first opening direction before or concurrently with actuating the second drive actuator to apply a motive force to the disconnect switch in an opposing second opening direction during an opening operation to define a separation gap between the fixed and movable contacts.

The method can further include actuating the first drive actuator in a first closing direction before or concurrently with actuating the second drive actuator in a second opposing closing direction to establish a closed state of the disconnect switch with the fixed and main contacts abutting each other.

The method can further include latching the fixed and movable contacts in an open and/or closed position using at least the second actuator.

During an opening operation, the actuating the first drive actuator can be carried out to pull the movable contact away from the fixed contact by the motive force applied by the first drive actuator to force the movable contact away from the fixed movable contact to an initial interruption gap, then the first drive actuator ceases applying any motive force, and the actuating the second drive actuator can be carried out to apply its motive force for a longer duration than the first drive actuator applies its motive force to move a vacuum chamber enclosing the fixed and movable contacts away from the first drive actuator to increase a separation distance between the movable and fixed contacts from the initial interruption gap and thereby create an insulation gap.

The method can also include applying a spring contact force against the fixed contact toward the movable contact when the disconnect switch is in the closed state.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

FIG. 5A illustrates a closed configuration (normal conduction). FIG. 5B illustrates an initial open (interruption) position. FIG. 5C illustrates a fully open (isolation) position.

DETAILED DESCRIPTION OF EMBODIMENTS OF THE INVENTION

Figure 1:
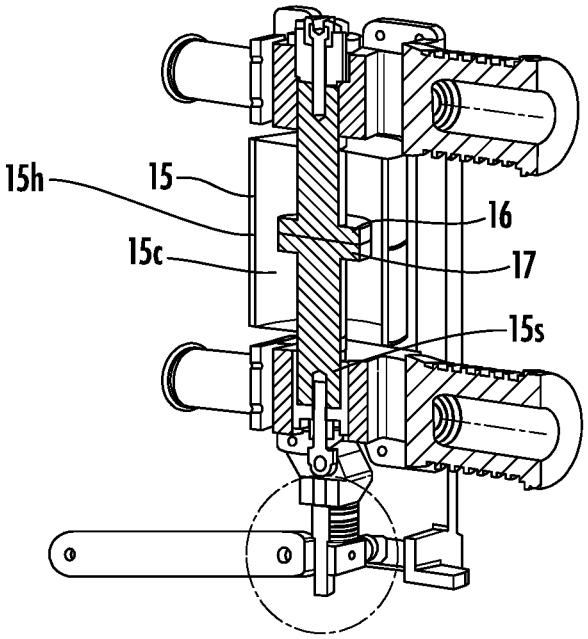
FIG. 1 (PRIOR ART)
FIG. 1 is a partial section schematic view of an example prior art VI.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings.

In addition, the sequence of operations (or steps) is not limited to the order presented in the flowcharts and claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. Broken lines in the flow charts represent optional features or steps.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 2:
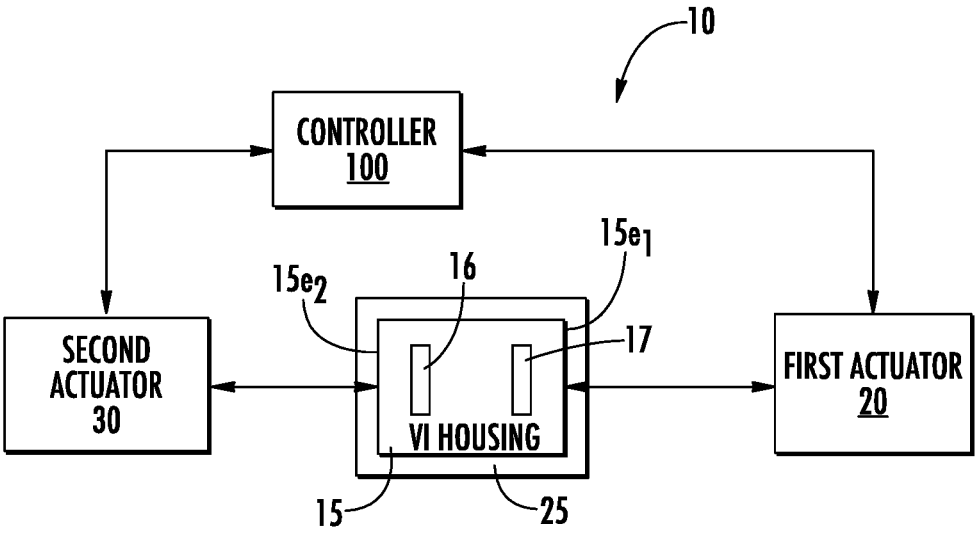
FIG. 2 is a schematic illustration of a circuit of a disconnect switch according to embodiments of the present invention.
Figure 3:
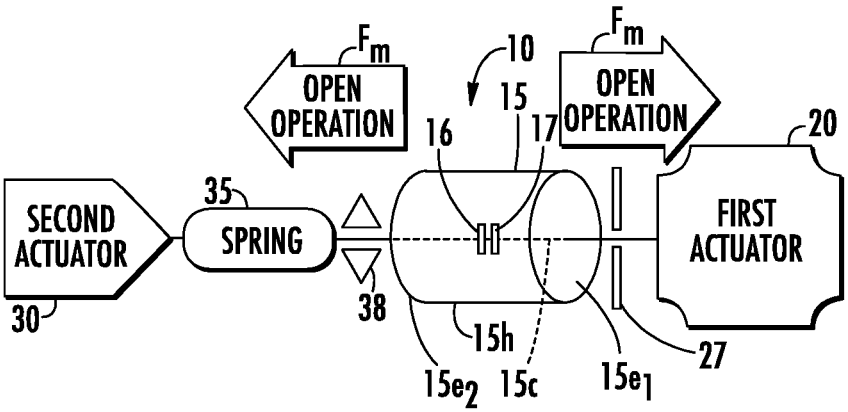
FIG. 3 is a schematic illustration of a disconnect switch according to embodiments of the present invention.
Figure 8:
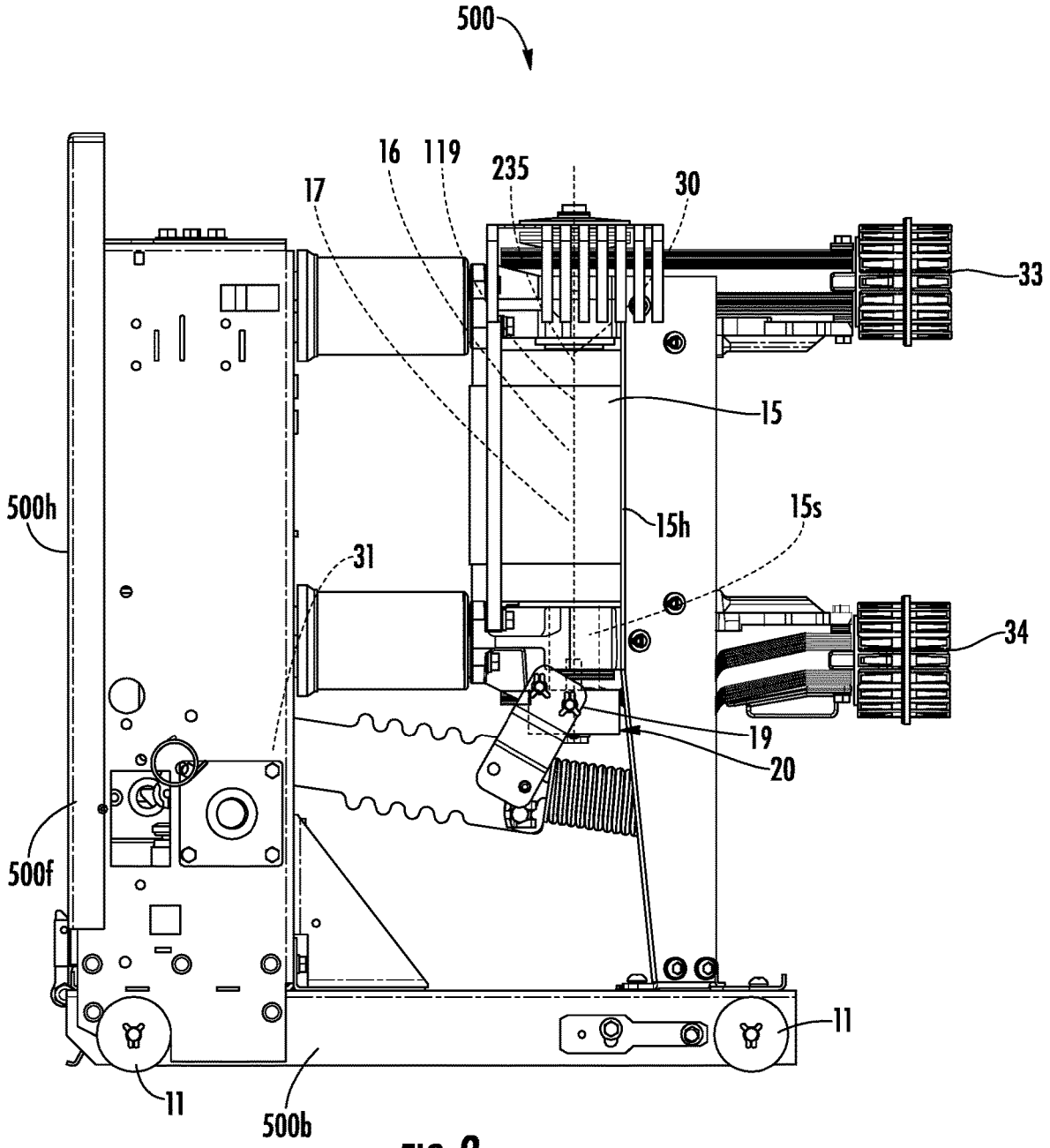
FIG. 8 is an example circuit breaker according to embodiments of the present invention.

Referring to FIGS. 2 and 3, a disconnect switch 10 according to exemplary embodiments is shown. The disconnect switch 10 can be used as a standalone switch or a bypass switch in hybrid circuit breakers for either AC or DC application. FIG. 8 illustrates an example circuit interrupter 500 (FIG. 8) that comprise one or more of the disconnect switches 10 according to exemplary embodiments. The circuit interrupter 500 can also be interchangeably referred to as a "circuit breaker".

Still referring to FIGS. 2 and 3, as shown, the disconnect switch 10 can comprise a vacuum interrupter 15 with a vacuum chamber 15*c* provided by a vacuum chamber housing 15*h*. The vacuum chamber housing 15*h* has axially opposing and spaced apart first and second end portions $\mathbf{15}e_1$, $\mathbf{15}e_2$ held by a VI body 25. As shown, the main stationary contact 16 and the main movable contact 17 reside in the vacuum chamber 15*c*.

The disconnect switch 10 also includes a first actuator 20 coupled directly or indirectly to the movable contact 17 and residing adjacent the first end portion $\mathbf{15}e_1$ of the vacuum chamber housing 15*h* of the vacuum interrupter 15 to provide a motive force Fm for an opening operation (in a direction away from the fixed contact 16) and for a closing operation to move the movable contact 17 toward the fixed, stationary contact 16.

The disconnect switch 10 also includes a second actuator 30 that can apply a motive force Fm2 in an opposing direction as that of the first actuator 20. The second actuator 30 can be configured to provide opening and closing operations with the motive force Fm in a first direction for opening and in an opposing second direction for closing.

The motive force Fm applied by the first actuator 20 is different than the motive force Fm applied by the second actuator 30.

The disconnect switch 10 can also include a controller 100 that can communicate with the first and second actuators 20, 30, respectively. The controller 100 can direct both of the first and second actuators 20, 30 to actuate to separate the fixed and movable contacts 16, 17 during an opening operation. The controller 100 can direct the first and second actuators 20, 30 to serially or concurrently close during a closing operation.

Figure 5A:
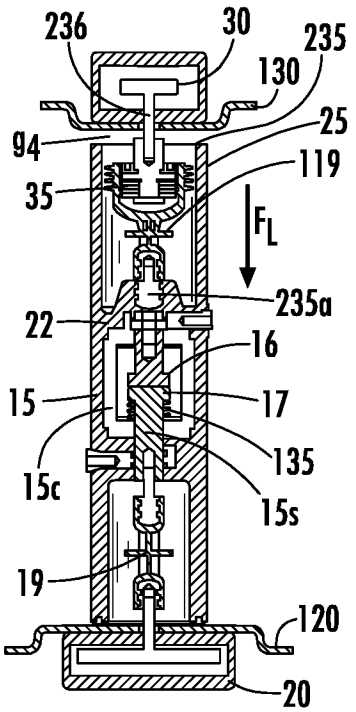
FIGS. 5A-5C are front, section views of a disconnect switch in three different operational positions according to embodiments of the present invention.
Figure 5B:
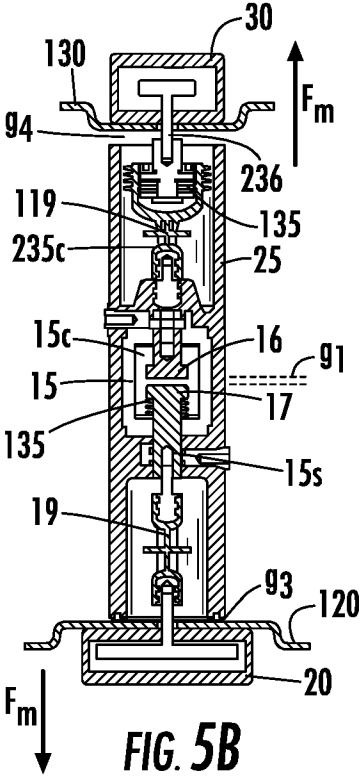
Figure 5C:
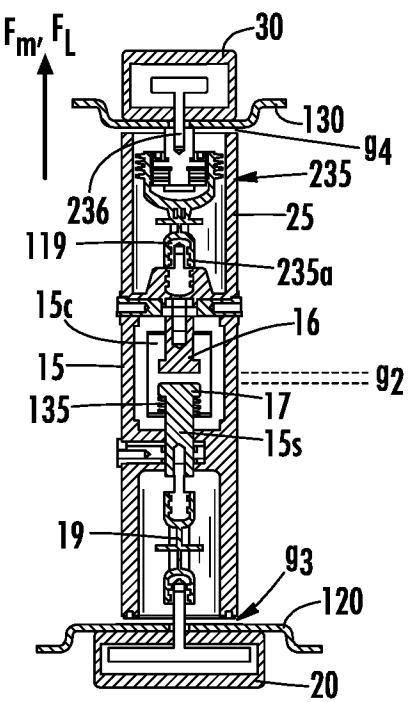

The second actuator 30 can also be configured to perform a latching operation to apply a latch force $F_L$ to latch the contacts 16, 17 (*a*) closed for normal operation (FIG. 5A) or (b) open when in an open state (FIG. 5C). The second actuator 30 can be configured to perform a damping operation during movement of the vacuum interrupter 15.

The first actuator 20 can also provide one or more of closing, latching and damping and the closing and latching can be applied concurrently and in an opposing direction as the closing and latching of the second actuator 30.

Although shown as a single first actuator 20 and a single second actuator 30, a plurality of first actuators may be used and/or a plurality of second actuators may be used (not shown).

Figure 4:
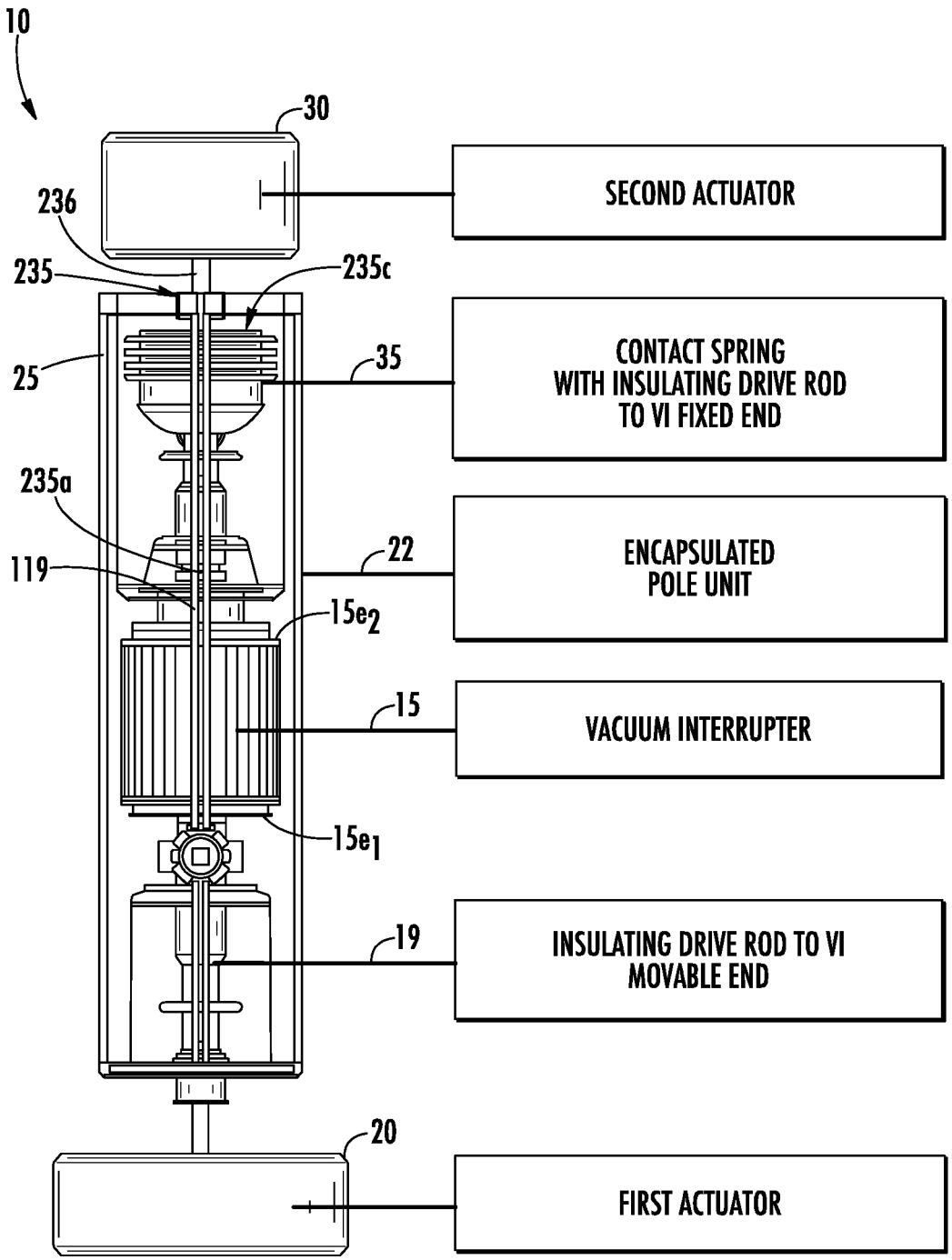
FIG. 4 is a front, partially transparent, view of an example disconnect switch according to embodiments of the present invention.

As shown in FIG. 3, the disconnect switch 10 can have a close position locator 27 to stabilize the VI during an opening operation to assist in a rapid or quick establishment of the initial interruption gap $g_1$ (FIG. 5B). The close position locator 27 can be held or coupled to a support member 120 (FIGS. 5A-5C), which can comprise one or more layers of shock absorption material, such as rubber, on a more rigid substrate to provide a suitable support structure. Embodiments of the invention, both the movable contact 17 (FIG. 3) and the whole pole unit body 22 (FIG. 4) move during closing or opening operations. The whole pole unit body 22 can sit on and/or at a definite position provided by the locator 27 when the switch in its closed status. The locator 27 can provide a suitably reasonable soft landing for the whole pole unit 22 during closing operation but a suitably reasonable stiff support during initial opening operation mainly initialized by the first actuator 20 (FIG. 3).

Referring to FIGS. 5A-5C, the first actuator 20 can force the movable contact 17 to move to an initial interruption gap $g_1$ (FIG. 5B) away from the fixed contact 16. The second actuator 30 can move the VI housing 15*h*, with the fixed contact 16 in a fixed position inside the VI housing, in a direction opposing the opening direction of the movable contact 17 to a position defining an insulation or isolation gap $g_2$ (FIG. 5C).

FIGS. 3 and 4 illustrate that the disconnect switch 10 can include a contact spring 35 that pushes from the fixed contact direction axially toward the movable contact 17, when the contacts 16, 17 are in a closed position to provide a desired contact force at the VI closed position (FIG. 5A).

FIG. 3 illustrates that the disconnect switch 10 can include a movable mass 38 that can be configured to stabilize the VI body 25 during opening operation to assist with a quick establishment of the initial interruption gap $g_1$. The moveable mass 38 can be adjustable in position relative to the vacuum interrupter 15 and/or adjustable in weight or movement characteristics.

Referring to FIGS. 4 and 5A-5C, the disconnect switch 10 has a primary VI body 25 that extends between the first and second actuators 20, 30 and that houses the vacuum interrupter 15 and includes an encapsulated pole unit 22. The second actuator 30 can be configured to pull the VI body 25 from a VI fixed end 15$e_2$ to establish the isolation status position/gap space $g_2$ to withstand short-time and lightening impulse voltages this results in the VI body 25 and the stationary contact 16 moving away from the moveable contact 17). The second actuator 30 can be coupled directly or indirectly to the vacuum interrupter 15 and/or VI body 25. As shown, the second actuator comprises a coupler assembly 235 that has an innermost arm 235*a* that is attached to the encapsulated pole unit 22. As also shown, the coupler assembly 235 has a chamber 235*c* that holds the contact spring 35 and an actuator attachment member 236 is coupled to the chamber 235*c* on a side away from the innermost arm 235*a*. The innermost arm 235*a* can be an electrically insulated drive rod 119 that is encased in epoxy adjacent the vacuum chamber housing 15*h* and/or at the pole unit 22. The actuator attachment member 236 can be axially aligned with the innermost arm 235*a*. However, other coupler assemblies may be used. For example, an external sleeve (not shown) can be attached to the end portion of the VI body 25 and used with the coupler assembly shown or used to attach the coupler attachment member 236 to the VI body 25 without the contact spring chamber 235*c* and/or inner arm 235*a* (not shown).

The second actuator 30 can be configured to move a greater mass than the first actuator 20. The second actuator 30 can provide a motive force Fm resulting in a slower velocity provided by the motive force Fm of the first actuator 20.

Embodiments of the invention move the movable contact 17 at a fast velocity from a closed position to the initial interruption gap $g_1$ followed by a slower velocity provided by the second actuator 30 in an opposing direction from the first actuator 20 to provide the isolation position $g_2$.

The first actuator 20 can have a different configuration than the second actuator 30 and can provide a motive force Fm to move the movable contact 17 to the initial interruption gap position $g_1$, after which the first actuator 20 may stop providing its motive opening force Fm. The first actuator 20 can comprise, for example, a Thompson coil or piezoelectric actuator. Other types of actuators can be used, alone or in combination. The first actuator 20 can be any type of actuators that are fast enough to establish the initial interruption gap $g_1$ in a suitable velocity. Examples, include, but are not limited to, electromagnetic, solenoid, motor, permanent magnet, pneumatic, hydraulic, electro-rheological, magneto-rheological, magnetostriction, linear or rotary versions of these. For a discussion of Thompson coil designs, see, e.g., Peng et al., Evaluation of Design Variables in Thompson Coil based Operating Mechanisms for Ultra-Fast Opening in Hybrid AC and DC Circuit Breakers, *IEEE Applied Power Electronics Conference and Exposition*, pages 2325-2332 (2015); Peng et al., A Fast Mechanical Switch for Medium Voltage Hybrid DC and AC Circuit Breakers, *IEEE Transactions on Industry Applications* 52(4):2911-2918 (2015); Wu et al., A New Thomson Coil Actuator: Principle and Analysis, *IEEE Transactions on Components, Packaging and Manufacturing Technology* 5(11):1644-1654 (2015). For a discussion of a piezoelectric actuator, see, e.g., Bosworth et al., High Speed Disconnect Switch with Piezoelectric Actuator for Medium Voltage Direct Current Grids, *IEEE Electric Ship Technologies Symposium*, pages 419-423 (2015). The contents of these documents are hereby incorporated by reference as if recited in full herein.

The second actuator 30 can comprise, for example, an electromagnetic actuator, a solenoid type actuator, a rheostat type actuator, a pneumatic actuator, a spring actuator, a motor actuator or a hydraulic actuator. Other types of actuators can be used. The second actuator 30 can be a single actuator or a single type of actuator or a plurality of cooperating actuators of the same type or of different types.

In some embodiments, $g_1$ is a range of 1 mm and 5 mm, more typically in a range of about 1 mm and about 3 mm. The first actuator 20 can provide the $g_1$ spacing in less than or equal to about 3 ms, such as 3 ms, 2.5 ms, 2 ms, 1.5 ms, 1 ms, and 0.5 ms or even less. The first actuator 20 can provide the only motive force to move the movable contact to the initial separation gap, $g_1$, in less than 3 ms.

In some embodiments, $g_2$ is in a range of 5-15 mm, such as 5 mm, 6 mm, 7 mm, 8 mm, 9 mm, 10 mm, 11 mm, 12 mm, 13 mm, 14 mm and 15 mm. To be clear, $g_2=g_1+D$, where "D" is the distance the VI body 25 moves.

The second actuator 30 can move the VI body 25 a distance D that is in a range of 3-15 mm, more typically a range of 4-8 mm, in a direction opposite the first actuator 20, typically in a time period of 10-85 ms, more typically in a time period of 20-50 ms, 20-40 ms, or 20-30 ms.

The speed to close the contacts 16, 17 is typically of no urgency and each of the first and second actuators 20, 30 can serially or concurrently cooperate to close the contacts to the closed position (FIG. 5C).

FIGS. 5A-5C illustrate that a bellows 135 can be coupled to the movable contact 17 as a conventional part of the vacuum interrupter.

During an opening event, a controller 100 (FIG. 2) can direct the first actuator 20 to actuate and direct the second actuator 30 to actuate, typically concurrently. The first actuator 20 can be configured to move the movable contact 17 at a first velocity. The second actuator 30 can be configured to move the VI body 25 at a slower velocity relative to the first velocity of the first actuator 20.

During the opening event, the first and second actuators 20, 30 can operate sequentially or concurrently. The first actuator 20 can apply a respective motive force Fm serially or concurrently with the second actuator 30. The first actuator 20 can stop applying a motive force, once the initial interruption gap $g_1$ is achieved and/or prior to the second actuator 30 applying its motive force Fm during an opening event.

The movable main contact 17 can comprise an elongate, typically cylindrical, segment that forms a stem 15*s*. Where a vacuum chamber 15*c* is used, the stem 15*s* extends outside the vacuum chamber 15*c* and is coupled to an electrically insulated drive rod 19 at a location outside the vacuum chamber 15*c*, spaced apart from the movable contact 17.

The second end portion 15$e_2$ of the vacuum interrupter 15 can reside adjacent an encapsulated pole unit 22. The second end portion 15$e_2$ of the vacuum interrupter 15 can be coupled to an electrically insulated drive rod 119 that can define or form the innermost arm 235*a* of the coupler assembly 235 and that resides between the vacuum interrupter 15 and the second actuator 30. The contact spring 35 can reside between the second end portion 15$e_2$ of the vacuum interrupter 15 and the second actuator 30, in the VI body 25.

The disconnect switch 10 can also include a support member 130 for the second actuator 30 and a support member 120 for the first actuator 20. The support members 120, 130 can be stationary and coupled to a housing, such as an internal wall or mounting feature of a cabinet housing 500*h* of a circuit breaker 500 (FIG. 8).

The second actuator 30 can move the VI body 25 away from the first actuator 20 and provide a gap space $g_3$ between an end of the VI body 25 and the support member 120 when in a fully open status (FIG. 5C). When in the fully closed state or initial open state (FIGS. 5A, 5B), there can be a gap space $g_4$ between the support member 130 and the adjacent end of the VI body 25 that is greater than that same gap space when in the fully open state (FIG. 5C).

The gap space $g_3$ can be smaller in the fully closed state (FIG. 5A) and initial open state (FIG. 5B) than when in the fully open state (FIG. 5C). In some embodiments, $g_4$, measured when the disconnect switch 10 is in the fully closed state, is $>g_3$, measured when the disconnect switch 10 is in the fully open state. In some embodiments, in the fully closed state, $g_4$ is in a range of 5-20 mm and in the fully open state, $g_3$ is in a range of 4-19 mm.

As shown in FIG. 8, the disconnect switch 10 can be held in a circuit interrupter 500 that also includes an upper terminal 33 and a lower terminal 34 (typically three parallel and laterally spaced apart upper and lower terminals for a three pole circuit interrupter). The circuit interrupter 500 includes a cabinet or main housing 500*h* and can include a base 500*b*, optionally comprising wheels 11.

In contemporary AC circuit breakers, the opening and closing times are in the range of 30-85 ms, out of which an actual arcing time is ½ to 1 cycle of the AC current, i.e., 16 ms in the U.S. with 60 Hz frequency or 20 ms in other countries of the world. Embodiments of the present invention provide the initial interruption position (FIG. 5B) in under 3 ms, more typically in 0.5 ms-1.5 ms, such as 1 ms to 2 ms or less, followed by an isolation position (FIG. 5C) in 20-50 ms, more typically 20-40 ms or 20-30 ms.

Figure 7:
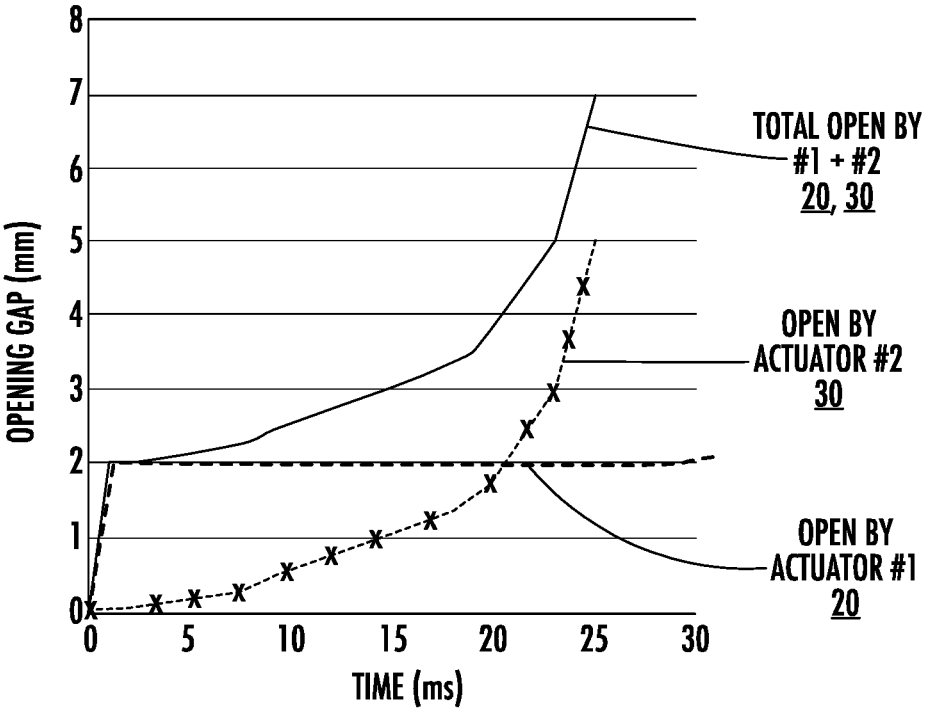
FIG. 7 is a graph of an example opening operation of distance (mm) versus time (ms) according to embodiments of the present invention.

FIG. 7 illustrates a timing graph (mm vs. ms) of an example opening operation. The first actuator 20 provides an opening gap of about 2 mm in about 2 ms or less, then stops and does not provide further motive force for opening. The second actuator 30 (lowest line marked with the "x" delineation) initiates opening movement (in an opposing direction as the first actuator) at the same time as the first actuator 20 or within 2 ms thereof and continues to operate to provide an opening gap distance of about 5 mm. In total, the first and second actuators 20, 30 cooperate to provide a cumulative opening gap distance of about 7 mm.

Thus, in some embodiments, the first and second actuators 20, 30, respectively, receive an open command simultaneously and can respond simultaneously. The first actuator 20 moves faster and reaches a 2 mm contact (initial interruption) gap in 1 ms (or less) in one direction, then stops at 2 mm. The second actuator 30 moves slower than the first actuator 20 and opens the contact gap to 5 mm in 25 ms in an opposing direction, then it stops there. The first and second actuators 20, 30 provide a total contact opening gap (isolation gap) of 7 mm in 25 ms in this example.

Referring again to FIG. 2, the controller 100 can include at least one processor (i.e., digital signal processor) 100. The controller 100 can be onboard the circuit interrupter 500 (FIG. 8) and can be in communication with sensors and/or current transformers that can engage stabs of switchgear to measure current occurring during an opening, closing or shorting event, for example.

Figure 6:
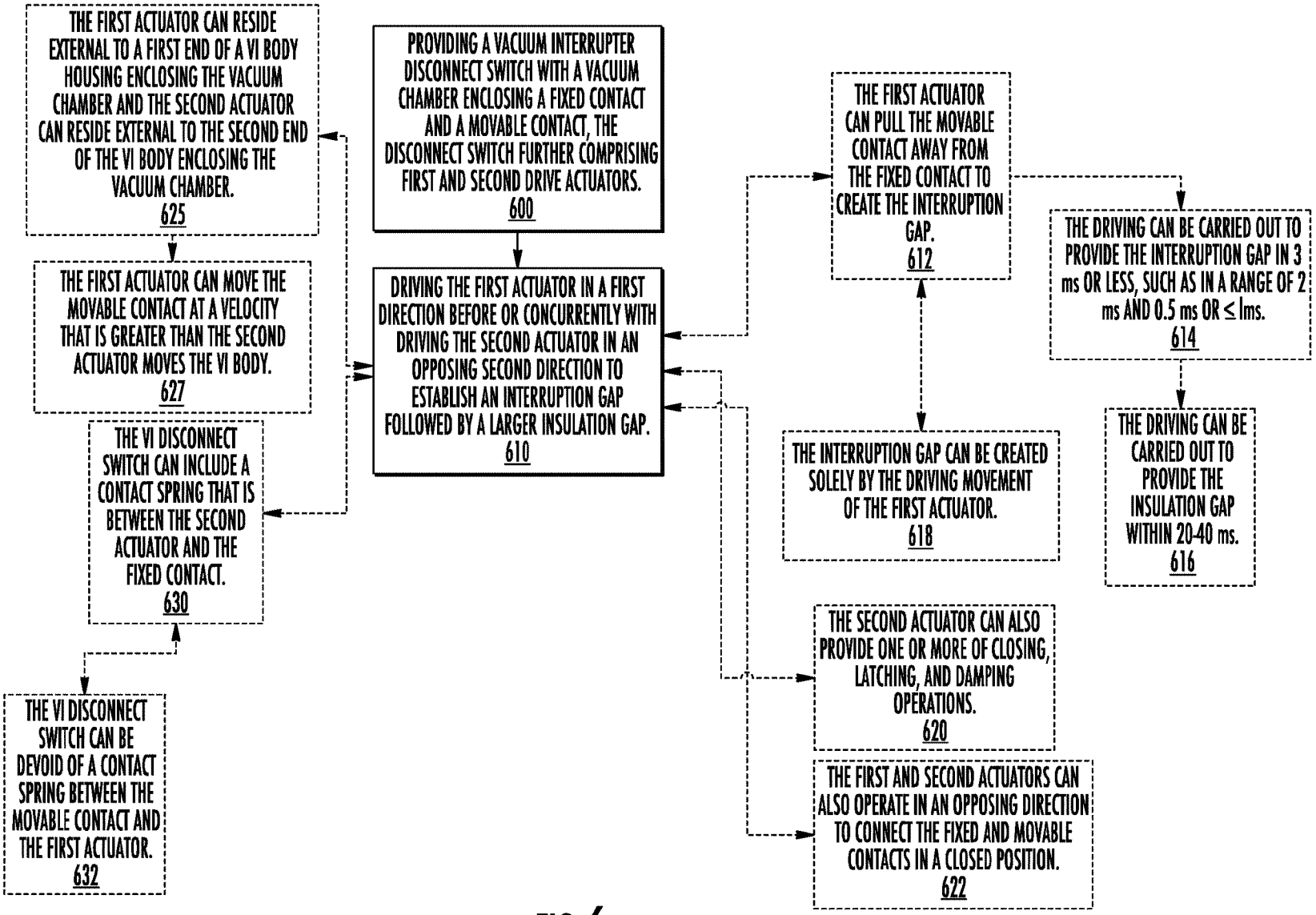
FIG. 6 is a flow chart of example actions that can be used to operate a disconnect switch according to embodiments of the present invention.

FIG. 6 is an example flow chart of operations that can be used for operating a disconnect switch according to embodiments of the present invention. A vacuum interrupter disconnect switch with a vacuum chamber enclosing a fixed contact and a movable contact can be provided, the disconnect switch further comprising first and second drive actuators (block 600). The first actuator can be driven in a first direction before or concurrently with driving the second actuator in an opposing second direction to establish an isolation gap, i.e., an initial interruption gap followed by a larger insulation gap (block 610).

The first actuator can pull the movable contact away from the fixed contact to create the interruption gap (block 612).

The driving of the first actuator can be carried out to provide the interruption gap in 3 ms or less, such as in a range of 2 ms and 0.5 ms (block 614).

The driving of the second actuator can be carried out to provide the insulation gap within about 20 ms-40 ms (block 616).

The interruption gap can be created solely by the driving movement of the first actuator (block 618).

The second actuator can also provide one or more of closing, latching and damping operations (block 620). The first actuator can also provide one or more of closing, latching and damping and the closing and latching can be applied concurrently with the closing and latching of the second actuator.

The first and second actuators can also operate in an opposing direction from the opening direction to close and connect the fixed and movable contacts (block 622).

The first actuator can reside external to a first end of a VI body housing enclosing the vacuum chamber and the second actuator can reside external to an axially spaced apart and opposing second end of the VI body housing (block 625).

The first actuator can move the movable contact at velocity that is greater than the velocity that the second actuator moves the VI body housing (block 627).

The VI disconnect switch can include a contact spring that is between the second actuator and the fixed contact (block 630).

The VI disconnect switch can be devoid of a contact spring between the movable contact and the first actuator (block 632).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A disconnect switch, comprising:

a housing;

a fixed main contact in the housing;

a movable main contact in the housing in cooperating alignment with the fixed main contact;

a first actuator coupled to the movable main contact; and a second actuator coupled to the housing, wherein the second actuator is configured to apply a motive force to the housing that is in a direction opposing a motive force applied by the first actuator to the movable main contact.

2. The disconnect switch of claim 1, further comprising:

a vacuum interrupter body enclosing the housing;

a vacuum chamber provided by the housing, wherein the fixed and moveable main contacts reside in the vacuum chamber;

a first drive rod in the vacuum interrupter body coupled to and extending between the movable contact and the first actuator; and a second drive rod in the vacuum interrupter body coupled to and extending between the housing and the second actuator.

3. The disconnect switch of claim 2, wherein, during an opening operation, the second actuator moves the vacuum interrupter body away from the first actuator, and wherein the disconnect switch comprises a gap space between an end of the vacuum interrupter body facing the second actuator and an adjacent support member, and wherein when the disconnect switch is in a fully closed state and an initial open state, the gap space is greater than when in a fully open state.

4. The disconnect switch of claim 3, when in the fully closed state, the gap space is in a range of 5-20 mm.

5. The disconnect switch of claim 1, further comprising a contact spring coupled to the housing and residing between the housing and the second actuator, wherein, in operation, during a closed state of the disconnect switch, the contact spring applies a closing force toward the movable main contact.

6. The disconnect switch of claim 1, wherein the disconnect switch has an open position associated with fully open state and a closed position associated with a fully closed state allowing electrical conduction, wherein, in the open position, the fixed and movable main contacts are spaced apart, wherein, in the closed position, the fixed and movable main contacts abut, and wherein the second actuator is configured to apply a latching force to latch the movable and fixed main contacts together in the closed position and apart in the open position.

7. The disconnect switch of claim 5, wherein the first actuator comprises a Thompson coil actuator.

8. The disconnect switch of claim 1, further comprising a controller in communication with the first actuator and the second actuator, and wherein the controller directs the first and second actuators to actuate to move in opposing directions during an opening operation.

9. The disconnect switch of claim 1, further comprising a coupler assembly that directly or indirectly attaches the second actuator to the housing, wherein the coupler assembly comprises a contact spring chamber that holds a contact spring, and wherein the second actuator comprises a coupler attachment member that is configured to compress the contact spring to apply a closing and/or latching force against the housing in a direction toward the movable main contact.

10. The disconnect switch of claim 1, wherein only the first actuator provides the motive force to move the movable main contact to an initial interruption gap position in a first direction, and wherein only the second actuator provides the motive force to move the housing in a second direction opposing the first direction to move the fixed main contact away from the movable contact whereby the fixed and movable main contacts are spaced apart in an insulation gap position, wherein there is a greater spacing between the fixed and movable main contacts in the insulation gap position.

11. The disconnect switch of claim 1, further comprising a support member residing between an end of the vacuum interrupter body and the first actuator, and wherein when the disconnect switch is in a fully closed state and an initial open state, a gap space between the end of the vacuum interrupter body and the support member is less than when in a fully open state.

12. The disconnect switch of claim 1, wherein the first actuator moves the movable main contact at a first velocity to an initial interruption gap position away from the fixed main contact that is in a range of about 1-3 mm, and wherein the second actuator moves the housing at a second velocity that is less than the first velocity and at a distance that is in a range of about 3 mm-15 mm whereby the disconnect switch has an isolation gap between the fixed and movable main contacts that is in a range of about 5 mm-15 mm.

13. The disconnect switch of claim 12, wherein the first actuator is configured to apply the motive force to move the movable main contact away from the fixed main contact to provide the initial interruption gap in less than 3 ms, then stops applying the motive force, and wherein the second actuator is configured to apply the motive force to move the housing to a full opening travel distance in 20-50 ms whereby the fixed and movable main contacts are separated by the isolation gap.

14. The disconnect switch of claim 1, wherein the first and second actuators are axially aligned and spaced apart with the housing therebetween, and wherein the first and second actuators each comprise a coupling drive member that are axially aligned with each other and extend external to a vacuum interrupter body enclosing the housing therein.

15. The disconnect switch of claim 1 in a cabinet housing of a circuit interrupter comprising a plurality of poles.

16. A method of closing and opening contacts of a disconnect switch, comprising:

providing a vacuum interrupter disconnect switch with a vacuum chamber enclosing a fixed contact and a movable contact, wherein the disconnect switch further comprises first and second drive actuators; and actuating the first drive actuator to apply a motive force to the movable contact in a first opening direction before or concurrently with actuating the second drive actuator to apply a motive force to the disconnect switch in an opposing second opening direction during an opening operation to define a separation gap between the fixed and movable contacts.

17. The method of claim 16, further comprising actuating the first drive actuator in a first closing direction before or concurrently with actuating the second drive actuator in a second opposing closing direction to establish a closed state of the disconnect switch with the fixed and movable contacts abutting each other.

18. The method of claim 17, further comprising applying a spring contact force against the fixed contact toward the movable contact when the disconnect switch is in the closed state.

19. The method of claim 16, further comprising latching the fixed and movable contacts in an open and/or closed position using at least the second actuator.

20. The method of claim 16, wherein, during the opening operation, the actuating the first drive actuator is carried out to pull the movable contact away from the fixed contact by the motive force applied by the first drive actuator to force the movable contact away from the fixed contact to an initial interruption gap, then the first drive actuator ceases applying the motive force, wherein the actuating the second drive actuator applies the motive force for a longer duration than the first drive actuator applies the motive force to move the vacuum chamber enclosing the fixed and movable contacts away from the first drive actuator to increase the separation distance between the movable and fixed contacts from the initial interruption gap and thereby create an insulation gap.

* * * * *